United States Patent [19]

Nishida et al.

[11] Patent Number: 4,476,412

[45] Date of Patent: Oct. 9, 1984

[54] SPARK PLUG

[75] Inventors: Minoru Nishida; Tadashi Hattori, both of Okazaki; Takanori Yanagisawa, Chiryu, all of Japan

[73] Assignees: Nippondenso Co., Ltd., Kariya; Nippon Soken, Inc., Nishio, both of Japan

[21] Appl. No.: 309,847

[22] Filed: Oct. 8, 1981

[30] Foreign Application Priority Data

Oct. 10, 1980 [JP] Japan ..... 55-142270

[51] Int. Cl.[3] ..... H01T 13/02

[52] U.S. Cl. ..... 313/130; 313/131 A; 313/137

[58] Field of Search ..... 313/137, 136, 138, 141, 313/130, 131 R, 131 A

[56] References Cited

U.S. PATENT DOCUMENTS

| | | | |
|---|---|---|---|
| 2,961,563 | 11/1960 | Peras | 313/131 R |
| 4,092,558 | 5/1978 | Yamada | 313/138 X |
| 4,337,408 | 6/1982 | Sone et al. | 313/130 |
| 4,439,707 | 3/1984 | Hattori et al. | 313/137 X |

FOREIGN PATENT DOCUMENTS

| | | | |
|---|---|---|---|
| 54-30333 | 3/1979 | Japan | 313/130 |

OTHER PUBLICATIONS

Segall, Development of Low Voltage Shunted Surface Gap Spark and Igniter Plugs . . . , WadC Technical Report 55-191, Jan. 1955, pp. X-9.

Anonymous, Research Disclosure, No. 206, Jun. 1981, pp. 209-210, 20613 Spark Plug.

*Primary Examiner*—David K. Moore

*Assistant Examiner*—K. Wieder

*Attorney, Agent, or Firm*—Cushman, Darby & Cushman

[57] ABSTRACT

A spark plug having center and ground electrodes. One of the electrodes is covered with an insulator, a part of which includes outer and inner insulating layers. The outer insulating layer is formed of a heat-resistant and high voltage-resistant material. The inner insulating layer is formed of a material having a high dielectric constant and interposed between the outer insulating layer and the portion of the one electrode which is directed toward the other electrode.

13 Claims, 12 Drawing Figures

SPARK PLUG

BACKGROUND OF THE INVENTION

Field of the Invention

The present invention relates to spark plugs in which the polarization effect of an insulating layer is utilized to improve the spark discharge characteristic and the ignition performance.

The invention will be described with reference to the accompanying drawings, wherein.

DESCRIPTION OF THE PRIOR ART

In the field of internal combustion engines, there has been an increasing tendency to use lean air-fuel mixtures and high compression ratios from the stand point of exhaust emission control and fuel consumption. In any of the cases of using lean mixtures and of using high compression ratios, spark plugs are required to assure improved ignition performance, reduced electrode wear and lowered discharge voltage. While a widened discharge gap is generally effective to improve the ignition performance, there is a problem that the widened discharge gap increases the discharge voltage if a high compression ratio is employed in an associated engine. Thus, the spark gaps of spark plugs cannot be widened beyond a certain limit.

In an attempt to eliminate the problem discussed, there have been proposed in Japanese Laid-Open Patent Publication Nos. 50-20146 laid-open Mar. 3, 1975 and 52-145647 laid-open Dec. 3, 1977 spark plugs in which the polarization effect is efficiently utilized to decrease the discharge voltage and correspondingly widen the spark gaps of the plugs.

The spark plug disclosed in the Japanese Publication No. 52-145647 referred to above is constructed such that an insulator for insulating a center electrode from a plug shell extends into the gap defined between the center electrode and the ground electrode so that the two electrodes are faced each other with the insulator interposed therebetween. The relative positions of the center electrode, the insulator and the ground electrode are determined by the relative dimensions of the creaping gap, a small gap and the thickness of the insulator. So as to improve the ignitability, it is sufficient to increase the creaping gap only, whereas the creaping gap and the thickness of the insulator may be decreased to reduce the discharge voltage.

In the case of normal spark plugs designed to produce sparks across spark gaps, the discharge voltage is increased in linear relation to the increase in the pressure of the surrounding gas. In the case of the above-mentioned prior art spark plugs which utilize the polarization effect, there is a range in which the discharge voltage is constant irrespective of the increase in the gas pressure. By selecting the dimensions of the creaping gap, the small gap and the insulator thickness so as to efficiently utilize the range referred to, it is possible to lower the maximum discharge voltages throughout all the operating ranges of engines. Spark plugs having the discharge voltage properties discussed above are remarkably useful for high compression ratio engines.

Figure 1:
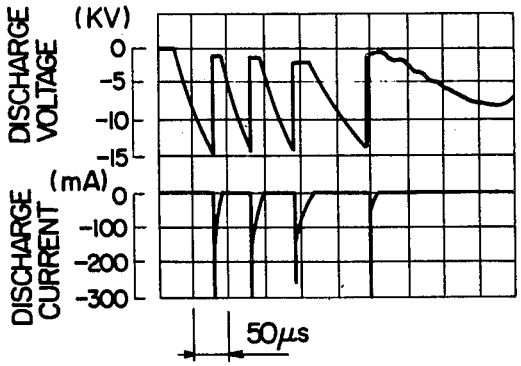
FIG. 1 PRIOR ART
FIG. 1 shows the discharge voltage and discharge current wave forms of the prior art spark plug obtained when the compression ratio has been increased.

The applicants prepared spark plugs which fell within the limited range, mentioned in the above-mentioned Japanese publication, in respect of the creaping gap, the small gap and the insulator thickness. The applicants conducted tests on these spark plugs in respect of the ignitabilities. It was observed that the ignitabilities were adversely affected by the increase in the compression ratio. In an attempt to see the reason, the discharge wave forms were watched. It was observed that, in a range above a certain compression ratio, there was a high probability that capacitive discharges are not followed by inductive discharges and the discharges are discontinued, as graphically shown in FIG. 1. In general, it takes more than several hundred micro seconds for a spark-ignited flame core to grow to an extent where the flame core operates to produce a flame-propagation. In order to reliably ignite an air-fuel mixture, it is required to continuously supply the mixture with an electric discharge energy after the commencement of the discharge. With the tested spark plugs, the discontinued discharges were the reason why the flame cores were not effectively supplied with electric discharge energy and the ignitabilities were deteriorated.

Figure 1A:
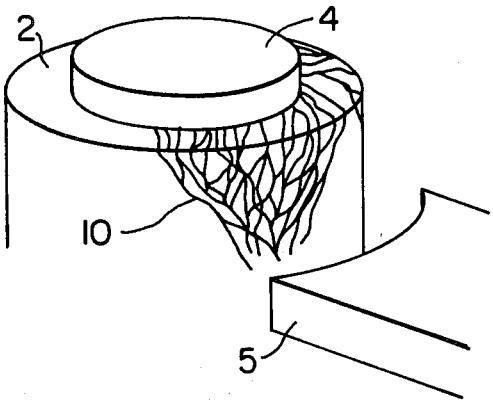
FIG. 1A PRIOR ART
Fig. 1A is an enlarged fragmentary perspective view of the prior art spark plug showing the paths of creaping discharges.

In order to examine the paths along which electric discharges would pass in the occasions where the discharges are discontinued, the surface of the plug insulator, on which creeping discharges would take place, was coated with a tracing material capable of indicating the paths of discharges. The plug was then used to examine the paths of discharge. The results of the examinations are shown in FIG. 1A which shows traces 10 of discharge extending from the opposite edges of the end extremity of the ground electrode 5 across the peripheral surface of the insulator 2 to the center electrode 4. As will be seen in FIG. 1A, the paths 10 of discharge are scattered over an area which extends widely in the circumferential directions of the insulator 2. Namely, the paths 10 of discharge are variable and very unsteady. For this reason, there occur many cases where sparks are of substantial lengths and electrolytically dissociated ions are diffused to increase the spark resistance whereby the discharge is interrupted to produce a discontinuity of discharge for thereby deteriorate the ignitability.

SUMMARY OF THE INVENTION

It is an object of the present invention to provide an improved spark plug in which the fluctuation of the paths of discharge is minimized to assure steady spark discharges and minimize the occurence of discontinuities of discharges for thereby improving the ignitability.

This object is achieved by the spark plug according to the present invention in which the insulator provide on one of the center and ground electrodes comprises first and second insulating layers. The first insulating layer surrounds the one electrode and comprises a heat-resistant and high voltage-resistant material, while the second insulating layer comprises a material having a high dielectric constant and interposed between the first insulating layer and the portion of the one electrode which is directed substantially toward the other electrode.

The above and other objects, features and advantages of the present invention will be made apparent by the following description of preferred embodiments with reference to FIGS. 2 through 7B.

DESCRIPTION OF PREFERRED EMBODIMENTS

Figure 2:
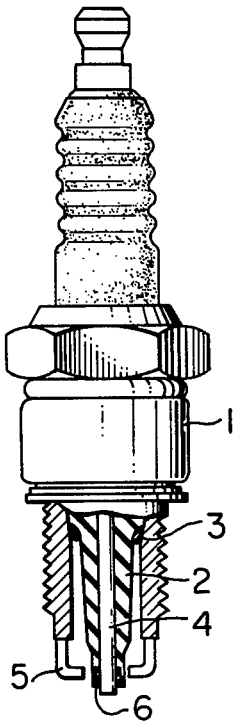
FIG. 2 is a partly sectional side elevation of an embodiment of the spark plug according to the present invention.
Figure 2A:
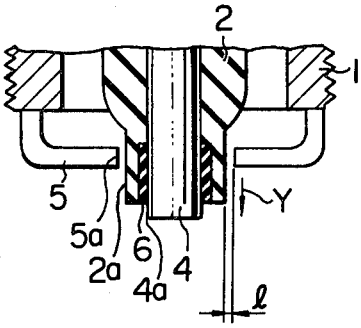
FIG. 2A is an enlarged fragmentary sectional view of the spark plug shown in FIG. 2.
Figure 2B:
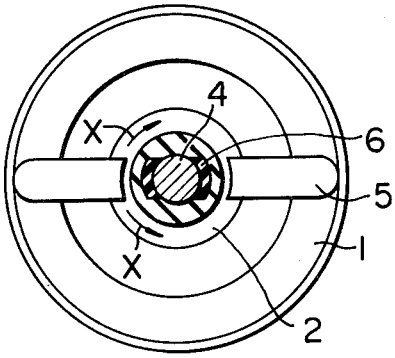
FIG. 2B is an enlarged, partly sectional bottom view of the spark plug shown in FIG. 2.

Referring first to FIGS. 2 to 2B, a spark plug includes a shell 1 of a metal. An insulator 2 of a heat-resistant and high voltage-registant material, such as $Al_2O_3$, is secured to the shell 1 by means of a packing 3. A center electrode 4 is surrounded by the insulator 2 and electrically insulated from the shell 1. A pair of ground electrodes 5 are secured to the end face of the shell 1 and disposed in diametrically opposite relationship with each other. The ground electrodes 5 are adapted to be grounded through the shell 1 to an associated engine body and have inwardly bent ends. Inner insulating layers 6 are provided between the insulator 2 and the portions of the center electrode 4 which are directed substantially toward the ground electrodes 5. The inner insulating layers 6 extend a distance axially of the center electrode 4 and are formed of a material having a high dielectric constant, such as $TiO_2$. The inner insulating layers 6 are made by calcination and are fixed to the center electrode 4 and the insulator 2 by means of an adhesive.

When a high electric voltage is applied across the electrodes 4 and 5, a strong electric field is formed initially across the shortest distance between the electrodes, i.e., the small pag l. However, since the center electrode 4 is covered with the insulator 2, no spark discharge is produced across the small gap l and, instead, the insulator 2 is charged, whereby the air-fuel mixture in the small gap l is ionized. The ionization develops successively in a direction toward weaker electric fields until the mixture among the end extremities 5*a* of the ground electrodes 5, the peripheral surface 2*a* of the insulator 2 and the end extremity 4*a* of the center electrode 4 is ionized, so that spark discharges are produced over a distance extending from the end extremities 5*a* of the ground electrodes 5 via the small gap l and the surface 2*a* of the insulator 2 to the end extremity 4*a* of the center electrode 4.

Assuming that the electric voltage applied to the center electrode 4 is of negative polarity, the ions formed adjacent to the surface 2*a* of the insulator 2 which is faced to the small gap l are positive ions and moved toward stronger negative electric fields. In the case where the insulator around the center electrode comprises a single layer of insulating material, as in the prior art spark plug, there occurs no appreciable difference in strength between the electric field in the circumferential directions of the insulator, as indicated by arrows X in FIG. 2B, and the electric field in the axial direction of the insulator, as indicated by an arrow Y in FIG. 2A. In this case, therefore, the positive ions are apt to move in the X directions.

However, in the case of the illustrated embodiment of the invention in which the inner insulating layers 6 of a material having a high dielectric constant are interposed between the insulating layer 2 and the portions of the center electrode 4 directed toward the ground electrodes 5 and such inner insulating layers are not provided between the other portions of the center electrode and the insulating layer 2, the electric potential at the surface of the insulator 2 which faces the small gap l is lowered with a resultant decrease in the strength of the electric field in the Y direction, whereby the positive ions cannot easily move in the X directions. For this reason, the shortest paths of discharge are formed in the Y direction and, at the same time, discharges cannot easily be produced in the X directions. Consequently, the fluctuation of the paths of discharges is minimized to assure steady paths of discharge as well as to suppress the occurrence of discontinuities of discharges for thereby improving the ignitability.

FIGS. 3 to 7B illustrate other embodiments of the spark plugs of the invention.

Figure 3:
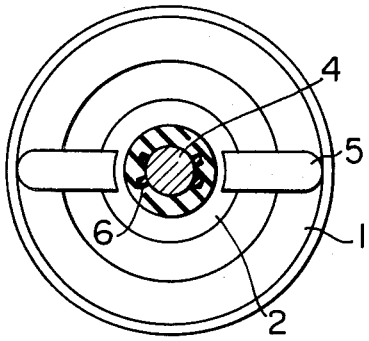
FIG. 3 is an enlarged, partly sectional bottom view of another embodiment of the spark plug according to the present invention.

In the embodiment shown in FIG. 3, the inner insulating layers 6 of the high dielectric constant material are disposed between the outer insulating layer 2 and those portions of the center electrode 4 which are directed toward the opposite edges of the end face of each of the ground electrodes 5, to thereby assure more steady paths of discharges.

Figure 4:
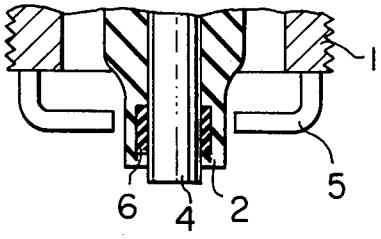
FIG. 4 is an enlarged fragmentary sectional view of a further embodiment of the spark plug according to the present invention.

In the embodiment shown in FIG. 4, the inner insulating layers 6 of the high dielectric constant material are completely convered with the outer insulating layer 2 so that the inner layers 6 are protected against break due to the electric discharges and also prevented from being easily removed from the spark plug.

Figure 5:
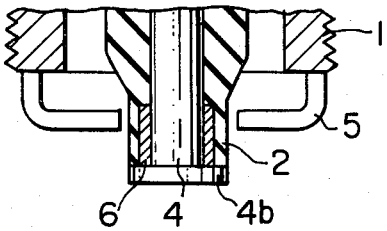
FIG. 5 is similar to FIG. 4 but illustrates a still further embodiment of the spark plug according to the present invention.

The embodiment shown in FIG. 5 includes a circular end plate or disc 4*b* attached to the end face of the center electrode 4 to provide a guard for the inner insulating layers 6 of the high dielectric constant material.

Each of the embodiments described above has two ground electrodes. However, it will be apparent to those in the art that either a single ground electrode or more than two ground electrodes may be used to provide a generally similar advantageous results.

Figure 6:
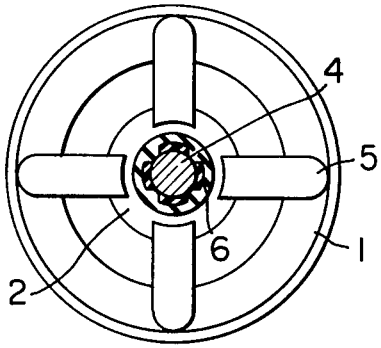
FIG. 6 is similar to FIG. 3 but illustrates a still further embodiment of the spark plug according to the present invention.

The embodiment shown in FIG. 6 has 4 ground electrodes 5 disposed around the center electrode 4 at substantially equal circumferential intervals.

Figure 7:
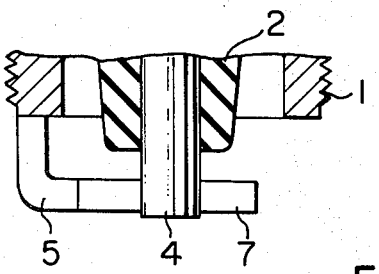
FIG. 7 is an enlarged, fragmental sectional view of a still further embodiment of the spark plug according to the present invention.
Figure 7B:
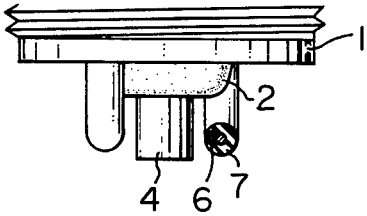
FIG. 7B is a partly sectional fragmentary side view of the spark plug shown in FIG. 7.
Figure 7A:
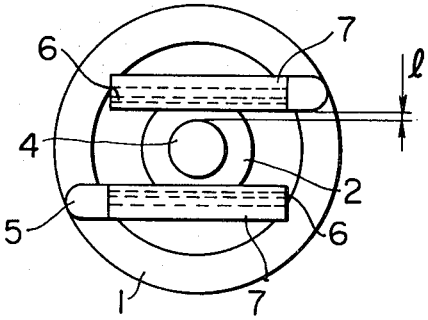
FIG. 7A is a bottom view of the spark plug shown in FIG. 7.

In the embodiment shown in FIGS. 7–7B, a pair of ground electrodes 5 have elongated end portions which are disposed on the opposite sides of the center electrode 4 and extend in parallel relationship with each other so that gaps are formed between the end portions of the respective ground electrodes and the center electrode. Each of the elongated end portions of the ground electrodes 5 is convered with an insulating layer 7 of a heat-resistant and high voltage-resistant material similar to the material of the insulating layer 2 of the preceding embodiments. An inner insulating layer 6 of a material having a high dielectric constant, similar to the material of the inner layers 6 of the preceding embodiments, is disposed between the insulating layer 7 and the portion of the elongated end of each ground electrode 5 which is directed generally toward the center electrode 4. The inner insulating layer 6 is co-extensive with the elongated end portion of each ground electrode 5.

While the high dielectric material has been described as being $TiO_2$, the high dielectric material may alternatively be selected from the group consisting of a compound of $TiO_2$ with an alkaline metal oxide (such as $BaTiO_2$, $CaTiO_2$ or $SrTiO_2$), a piezoelectric ceramic (such as $PbTiO_2$, $PbZrO_3$ or PZT), $NaNbO_3$, $KNbO_3$, $NaTaO_3$, $KTaO_3$ and mixtures of these materials with an additive for improving the properties thereof.

Each of the embodiments of the invention described above has been described as being provided with an insulator comprising two layers, namely, the inner layer 6 and the outer layer 2 or 7. However, more than two layers may be employed for the insulator.

Moreover, it has been described that each of the inner insulating layer 6 is disposed between the outer insulating layer 2 or 7 and the portion of one of the center and ground electrode which is directed substantially toward the other electrode. However, the inner insulating layer 6 may include a portion which extends slightly beyond said portion of the one electrode provided that the distance of the extension is not sufficient to cause spark discharges to run in the X directions as viewed in FIG. 2B.

As described, the present invention advantageously eliminates the formation of sparks which would run in the circumferential directions of the insulator of the spark plug, to thereby minimize the fluctuation of the paths of spark discharges, assure steady discharges and minimize discontinuities of discharges for thereby improving the ignitability of the spark plug.

What is claimed is:

1. A spark plug including:

a plug shell;

a center electrode substantially co-axial with said plug shell;

at least one ground electrode connected to said plug shell and cooperating with said center electrode to define a gap;

a first insulating layer surrounding one of said center and ground electrodes made of a heat-resistant and a high voltage-resistant material; and a second insulating layer made of a material having a high dielectric constant and interposed between said first insulating layer and only the portion of said one electrode which is directed substantially toward the other electrode wherein said second insulating layer is completely surrounded by said first insulating layer and said center electrode.

2. A spark plug including;

a plug shell;

a center electrode substantially co-axial with said plug shell;

at least one ground electrode connected to said plug shell and cooperating with said center electrode to define a gap;

a first insulating layer surrounding one of said center and ground electrodes made of a heat-resistant and high voltage-resistant material; and a second insulating layer made of a material having a high dielectric constant and interposed between said first insulating layer and only the portion of said one electrode which is directed substantially toward the other electrode wherein said ground electrode has an elongated portion bent to extend to cooperate with said center electrode to define said gap and wherein the combination of said first and second insulating layers is provided on said elongated and bent portion of said ground electrode.

3. A spark plug including:

an insulator;

a center electrode having an outer peripheral surface and a terminal end surface portion, said center electrode being held by said insulator;

a metallic shell secured to the other periphery of said insulator;

a ground electrode provided on said metallic shell to face an outer surface of said center electrode; and an insulating layer disposed on one of said electrodes said insulating layer being so disposed between said electrodes as to define a small gap between said insulating layer and the other electrode, said insulating layer including an inner insulating layer of a material having a high dielectric constant and an outer insulating layer of a material having a high resistance to heat and high voltage, said outer insulating layer being formed on said inner insulating layer, said inner insulating layer being formed on said one electrode and positioned only in that area of said one electrode which is faced toward said other electrode.

4. A spark plug according to claim 3, wherein said ground electrode has an end face directed toward the outer peripheral surface of said center electrode, said inner insulating layer being formed on said outer peripheral surface of said center electrode except on said terminal end surface portion, said outer insulating layer being constituted by a portion of said insulator extending over said inner insulating layer.

5. A spark plug according to claim 4, wherein said portion of said insulator extending over said inner insulating layer has a thickness smaller than those of the other portions of said insulator.

6. A spark plug according to claim 4, wherein a portion of the center electrode including said terminal end surface portion extends beyond said outer insulating layer.

7. A spark plug according to claim 6 wherein said inner insulating layer is completely covered by said outer insulating layer.

8. A spark plug according to claim 4, wherein said terminal end surface portion of said center electrode has a diameter greater than that of said inner insulating layer.

9. A spark plug according to claim 3, wherein said inner insulating layer has a plurality of segments formed on said one electrode and disposed only within the regions where said electrodes face toward each other.

10. A spark plug according to claim 3, wherein said other electrode comprises plural electrode segments and said inner insulating layer comprises a plurality of segments formed on said one electrode and disposed only in the regions of said one electrode where said one electrode and said plural electrode segments face toward each other.

11. A spark plug according to claim 3, wherein said ground electrode has a side face which faces toward the outer peripheral surface of said center electrode, and wherein said inner insulating layer is formed only on that side of said ground electrode which faces toward said center electrode and said outer insulating layer is formed on said inner insulating layer and on said ground electrode.

12. A spark plug according to claim 10, wherein said ground electrode has an elongated portion having said side face facing toward said outer surface of said center electrode, said inner insulating layer being formed only on the side of said elongated portion facing toward said outer surface of said center electrode, and said outer insulating layer being formed on said inner insulating layer and on said elongated portion of said ground electrode.

13. A spark plug according to any one of claims 3 to 12, wherein said outer insulating layer is made of $Al_2O_3$, said inner insulating layer being made of a material selected from the group consisting of $TiO_2$, ($BaTiO_2+TiO_2$), ($CaTiO_2+TiO_2$), ($SnTiO_2+TiO_2$), $PbTiO_2$, $PbZrO_3$, PzT, $NaNbO_3$, $KNbO_3$, $NaTaO_3$, and $KTaO_3$.

* * * * *